US006668761B2

(12) United States Patent
Tsigrik

(10) Patent No.: US 6,668,761 B2
(45) Date of Patent: Dec. 30, 2003

(54) DEVICE FOR COLLECTING EXCREMENTS

(76) Inventor: Vladimir Tsigrik, 3721 55th St., Woodside, NY (US) 11377

( * ) Notice: Subject to any disclaimer, the term of this patent is extended or adjusted under 35 U.S.C. 154(b) by 136 days.

(21) Appl. No.: 09/915,820

(22) Filed: Jul. 26, 2001

(65) Prior Publication Data

US 2003/0041809 A1 Mar. 6, 2003

Related U.S. Application Data

(60) Provisional application No. 60/221,160, filed on Jul. 27, 2000.

(51) Int. Cl.[7] ..... A01K 23/00
(52) U.S. Cl. ..... 119/867; D7/686
(58) Field of Search ..... 119/806, 867; D7/686; 37/184, 461; 294/11, 26; 588/259

(56) References Cited

U.S. PATENT DOCUMENTS

D117,381 S * 10/1939 Nelson ..... D7/686
3,606,435 A * 9/1971 Weber ..... 37/461
3,986,744 A * 10/1976 Krogstad et al. ..... 119/867
D284,440 S * 7/1986 Zieff ..... D7/686
D297,899 S * 10/1988 Kato ..... D7/686
6,227,149 B1 * 5/2001 Host et al. ..... 119/867
6,505,578 B1 * 1/2003 Scott et al. ..... 119/867

* cited by examiner

*Primary Examiner*—Charles T. Jordan
*Assistant Examiner*—Elizabeth Shaw
(74) *Attorney, Agent, or Firm*—I. Zborovsky

(57) ABSTRACT

A device for collecting excrements has a one-piece body including two parts which are flexibly connected with one another to be moved between an open position in which the parts are spaced from one another, and includes position in which the parts are folded around a central line which forms a film hinge so that the parts are in contact with one another and close an inner space in which the excrements are accommodated.

15 Claims, 3 Drawing Sheets

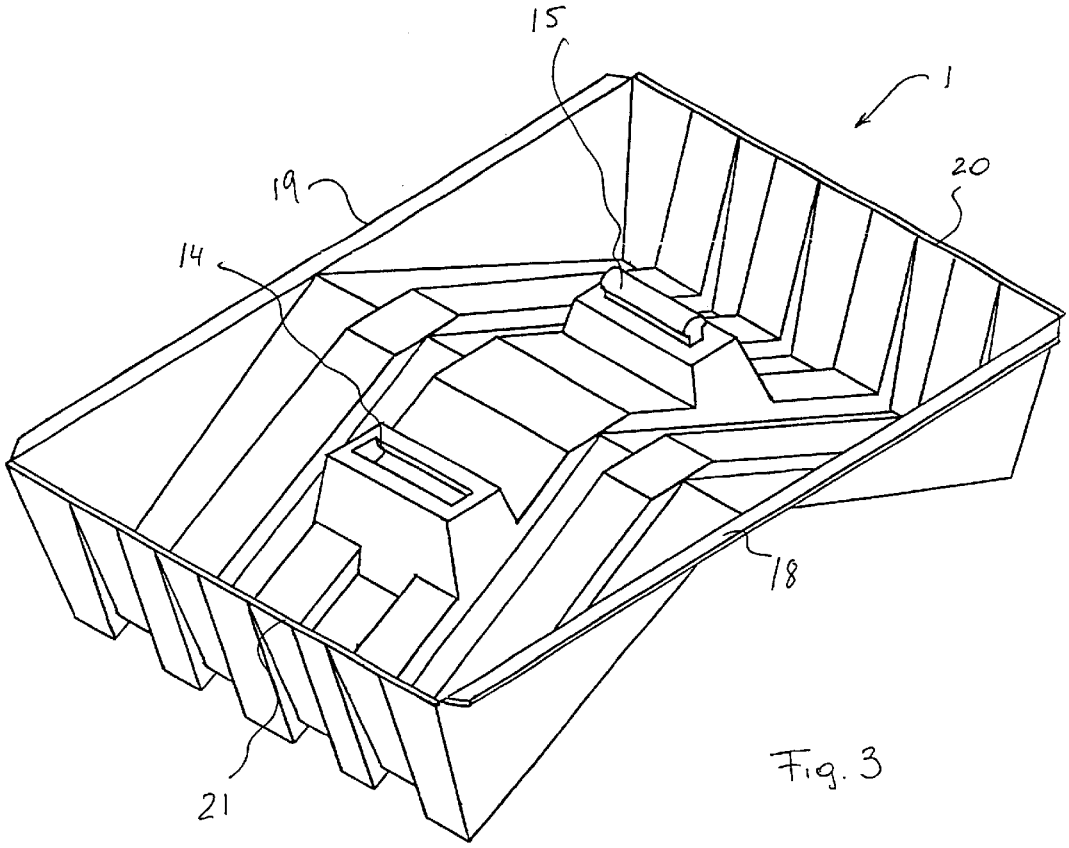
Fig. 3
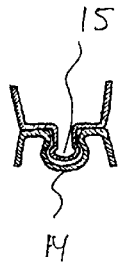

DEVICE FOR COLLECTING EXCREMENTS

This application claims the benefit of provisional application No. 60/221,160 filed Jul. 27, 2000.

TECHNICAL FIELD

The present invention relates to a device for collecting excrements.

More particularly it relates to a device for collecting animal excrements. More particularly, it relates a manual device for collecting excrements, for example after pet animals, when an owner walks the pet animal.

BACKGROUND ART

Devices for collecting excrements of the above mentioned general type are known in the art. Some devices include an elongated rod with a mechanical scoop at the end, which is used for scooping excrements. Thereafter, the excrements have to be removed from the scoop, and the scoop has to be cleaned. Another device of this type includes a bag which is mounted at the end of the elongated rod, and also is used for collecting excrements. It is believed that the existing devices can be improved.

DISCLOSURE OF THE INVENTION

Accordingly, it is an object of the present invention to provide a device for collecting excrements, which avoids the disadvantages of the prior art.

In keeping with these objects and with others which will become apparent hereinafter, one feature of present invention resides, briefly stated, in a device for collecting excrements, which includes a one-piece body which is foldable in a middle region between an open position in which two parts of the body at both sides of a fold are spaced from one another, and a closed position in which both parts of the body at both sides of the fold are in contact with one another and form an enclosed space in which the excrements can be accommodated, and locking means for locking the parts of the body with one another in the closed position, so that the locked parts with the excrements inside can be discarded.

When the device is designed in accordance with the present invention, it is easy to operate manually, it reliably scoops the excrements from a surface, and it locks the device in its closed position, so that the excrements can not escape and the device together with the excrements can be disposed as a disposable item.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a perspective view of the inventive device for collecting excrements from below;

BEST MODE OF CARRYING OUT THE INVENTION

Figure 1:
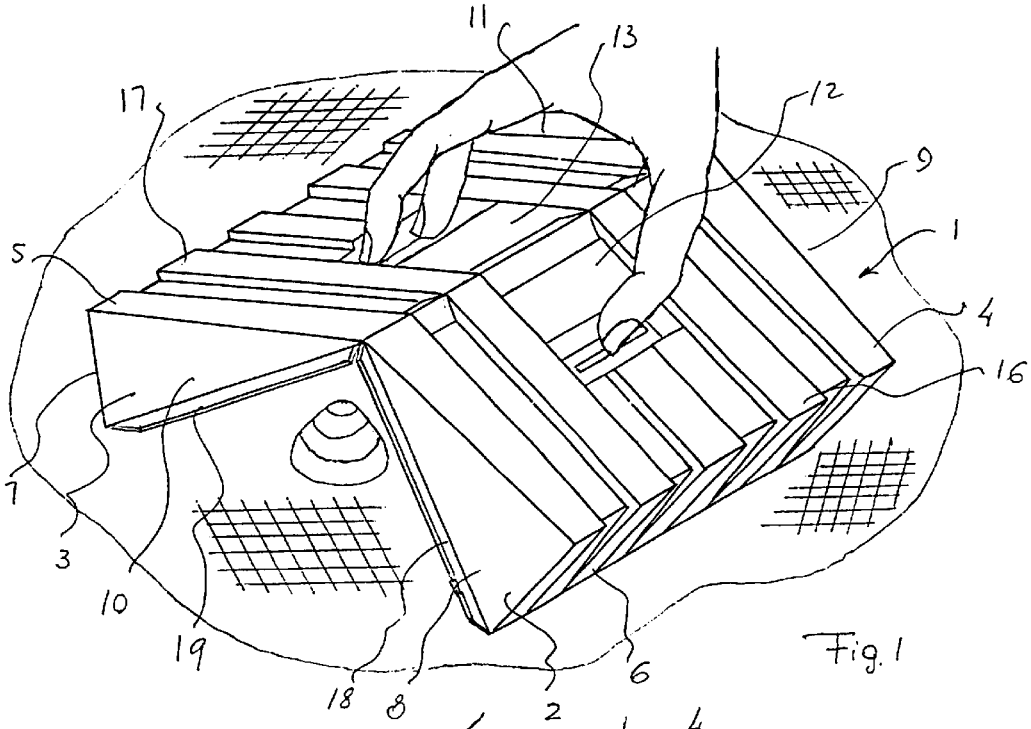
FIG. 1 is a perspective view of a device for collecting excrements in accordance with the present invention in an open position.
Figure 2:
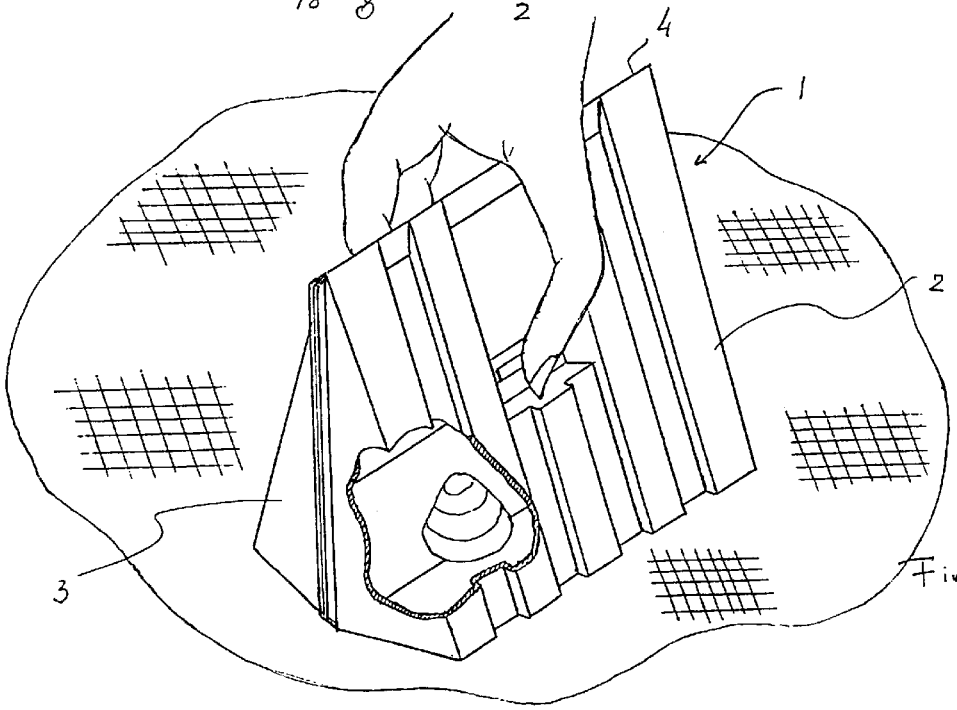
FIG. 2 is the device for collecting excrements in accordance with the invention in the closed position.
Figure 4:
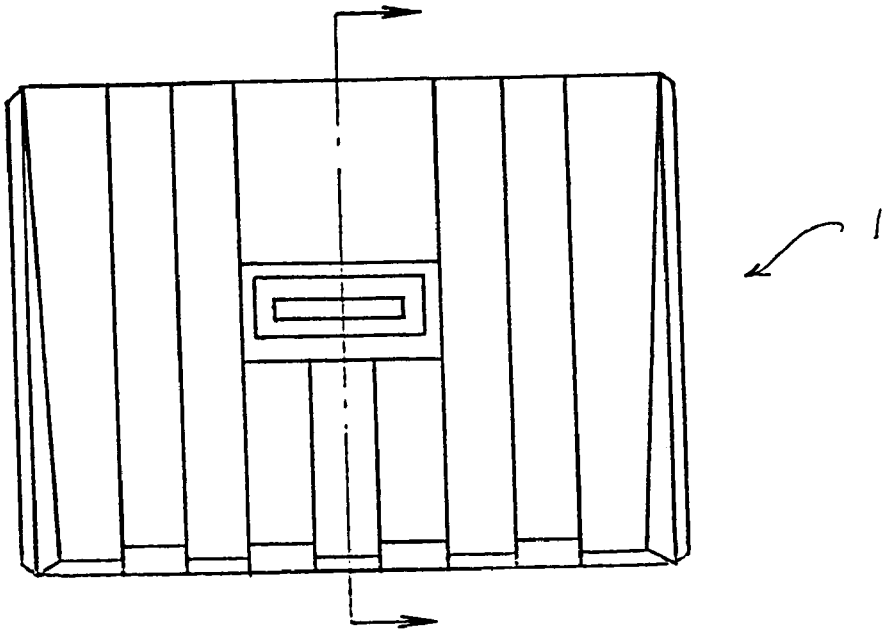
FIG. 4 is a plan view of the inventive device for collecting excrements in an open position.
Figure 5:
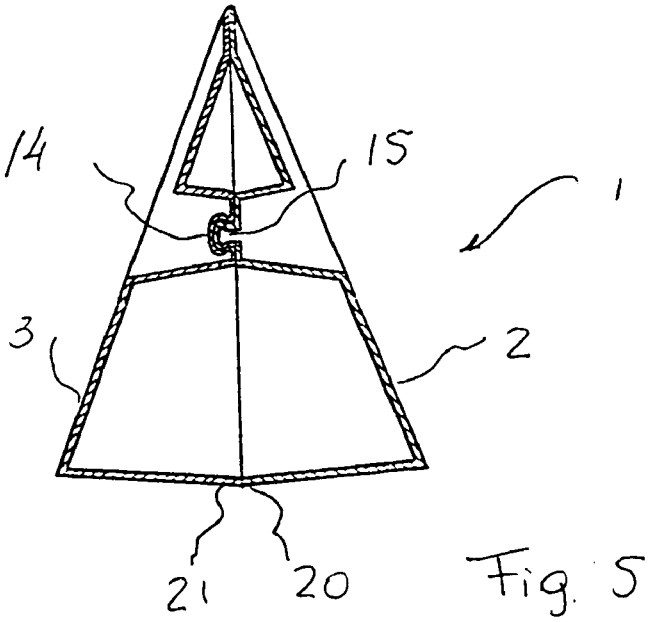
FIG. 5 is a cross-section of the device for collecting excrements in accordance with the present invention.

The device for collecting excrements in accordance with the present invention has a body which is identified as a whole with reference numeral 1. The body 1 is composed of two parts 2 and 3 which merge into one another in the middle of the body 1 along a line which forms a film hinge. The body 1 with its parts 2 and 3 can be composed of any suitable plastic. Each part 2, 3 has a side wall 4, 5, a bottom wall 6, 7, and two end walls 8, 9 and 10, 11.

As can be seen from the drawings, each part has a substantially triangular cross-section, or in particular the cross-section formed of a right triangle. The cross-section of the device in the closed position with two parts which are in contact with one another is formed as an isosceles triangle.

As can be seen from the drawings, the side walls 2, 3, have depressions 12, 13, into which fingers of the user can engage so as to hold and operate the device. The depressions 12 and 13 can be formed for example as inwardly punched portions of the side walls 2, 3. One of the depressions can be provided with a groove or a throughgoing opening 14, while the other of the depressions 3 can be provided with a projection 15 which can be undercut, so as to form together a lock as will be explained herein below.

Side walls 2 and 3 are provided with a plurality of corrugations 16, 17, to increase the rigidity of the parts 2, 3. The end walls 8, 9 and 10, 11 can be provided with flanges 18, 19, at both ends of the device, to further improve the rigidity of the side walls 2, 3, of the device. The free edges 20, 21 of the bottom walls 6, 7 are thin and/or even sharpened for the purpose which will be explained herein below. Also, all walls of the body 1 are inclined, so that in a storage conditions the devices can be stacked into one another.

The device operates in the following manner:

In the initial position the device is open as shown for example in FIG. 1. The user engages his fingers into the recesses 12 and 13 and grasps the sides 2 and 3 of the device. Then the user puts the device on a surface on which the excrements are deposited and presses the parts 2 or 3 of the device toward one another to cause a movement of the parts 2 and 3 toward one another, and the edges 20 and 21 of the bottom walls 6 and 7 slide over the surface and scoop the excrements from the surface because they are thin and/or sharp. Then, the parts 2 and 3 approach one another so as to be brought in direct contact with one another, at which point the undercut projection 15 engages into the recess or groove 14 because of the springy property of the plastic material, so that the parts 2 and 3 are locked with one another, and the excrements are reliably confined inside the device. The device can be disposed with the excrements inside.

It will be understood that each of the elements described above, or two or more together, may also find a useful application in other types of constructions differing from the types described above.

While the invention has been illustrated and described as embodied in device for collecting excrements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for collecting excrements, comprising a one-piece body including two parts which are flexibly connected with one another to be moved between an open position in which said parts are spaced from one another, and a closed position in which said parts are folded around a central line which forms a hinge so that said parts are in contact with one another and close an inner space in which the excrements are accommodated; and locking means for locking said parts in said closed position and including a locking projection provided on one of said parts and a locking recess provided on the other of said parts.

2. A device as defined in claim 1, wherein each of said parts has a cross-section of a triangle, so that when the parts are in said closed position, they also form a triangle.

3. A device as defined in claim 1, wherein each of said parts has a side wall, said projection and said recess being in said side walls of said parts.

4. A device as defined in claim 3, wherein each of said side walls is provided with a recess for engagement by fingers of the user, each of said recesses being formed as an inwardly offset part, said projection and said recess of said locking means being formed on said inwardly offset parts.

5. A device as defined in claim 4, wherein each of said parts has a side wall provided with corrugations, which have recesses for engagement by fingers.

6. A device as defined in claim 1, wherein each of said parts has a side wall, said side walls being provided with corrugations for increasing a rigidity of the device.

7. A device as defined in claim 1, wherein each of said parts has an end wall, each of said walls being provided with a flange for increasing a rigidity of said parts.

8. A device as defined in claim 7, wherein said parts have conical end walls provided with conical recess for engagement by fingers of the user.

9. A device as defined in claim 1, wherein each of said parts has a lower wall with a free edge formed so as to scoop excrements from a surface.

10. A device as defined in claim 9, wherein said free edge is substantially thin.

11. A device as defined in claim 9, wherein said free edge is substantially sharp.

12. A device for collecting excrements, comprising a one-piece body including two parts which are flexibly connected with one another to be moved between an open position in which said parts are spaced from one another, and a closed position in which said parts are folded around a central line which forms a hinge so that said parts are in contact with one another and close an inner space in which the excrements are accommodated, each of said parts having a side wall provided with a recess for engagement by fingers of a user.

13. A device for collecting excrements, comprising a one-piece body including two parts which are flexibly connected with one another to be moved between an open position in which said parts are spaced from one another, and a closed position in which said parts are folded around a central line which forms a hinge so that said parts are in contact with one another and close an inner space in which the excrements are accommodated, wherein said parts are folded around said central line which forms a hinge and is a single line.

14. A device as defined in claim 11, wherein each of said parts has a side wall, said side walls being provided with corrugations for increasing a rigidity of the device, said side walls ending in said single line.

15. A device as defined in claim 14, wherein said corrugations are formed so that when said parts are in contact with one another said corrugations of said side parts are located adjacent to one another and do not interfere with one another.

* * * * *